US005749233A

United States Patent [19]

Adolfsson

[11] Patent Number: 5,749,233

[45] Date of Patent: May 12, 1998

[54] METHOD AND DEVICE FOR COOLING AND CARBONATING A LIQUID

[75] Inventor: Bengt Adolfsson, Stockholm, Sweden

[73] Assignee: Post-Mix Equipment AB, Solna, Sweden

[21] Appl. No.: 619,695

[22] PCT Filed: Sep. 19, 1994

[86] PCT No.: PCT/SE94/00870

§ 371 Date: Jun. 28, 1996

§ 102(e) Date: Jun. 28, 1996

[87] PCT Pub. No.: WO95/09124

PCT Pub. Date: Apr. 6, 1995

[30] Foreign Application Priority Data

Sep. 28, 1993 [SE] Sweden ..... 9303160

[51] Int. Cl.[6] ..... F17C 9/02

[52] U.S. Cl. ..... 62/50.2; 62/70; 222/129.1; 261/151; 261/DIG. 7

[58] Field of Search ..... 62/50.2, 70; 222/129.1; 261/151, DIG. 7

[56] References Cited

U.S. PATENT DOCUMENTS

| | | | |
|---|---|---|---|
| 2,195,449 | 4/1940 | Delen | 261/DIG. 7 |
| 4,011,733 | 3/1977 | Kückens et al. . | |
| 5,140,822 | 8/1992 | Gupta . | |
| 5,160,461 | 11/1992 | Durrows | 261/DIG. 7 |
| 5,184,942 | 2/1993 | Deininger et al. | 261/DIG. 7 |
| 5,231,851 | 8/1993 | Adolfsson . | |

FOREIGN PATENT DOCUMENTS

| | | |
|---|---|---|
| 2559651 | 5/1977 | Germany . |
| WO 90/15011 | 12/1990 | WIPO . |
| WO 94/12425 | 6/1994 | WIPO . |

OTHER PUBLICATIONS

Derwent's abstract, No. 83-831592/48, weeek 8348, Abstract of SU, 992341 (Novch Poly), 5 Feb. 1983.

*Primary Examiner*—Ronald C. Capossela
*Attorney, Agent, or Firm*—Quarles & Brady

[57] ABSTRACT

In a method and a device for cooling and carbonating a liquid (20), carbon dioxide intended for carbonating is also used for cooling, the carbon dioxide being brought to expand in a room (4; 7) which is separate from the liquid (20) but which is thermally connected to the liquid. By the invention it is achieved that an ice bank is formed in the liquid in the area which is adjacent to said expansion room (4; 7) whereby is achieved i.a. better cooling control than in previously known devices where the carbon dioxide also is used for cooling.

18 Claims, 2 Drawing Sheets

METHOD AND DEVICE FOR COOLING AND CARBONATING A LIQUID

Figure 1:
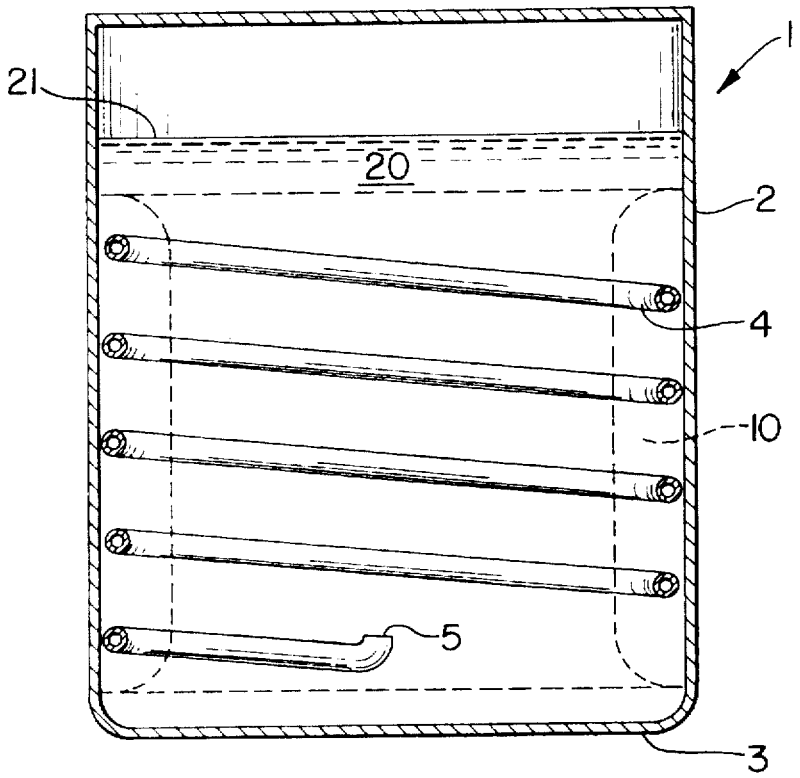

This invention concerns a method and a device according to the respective preambles of claim 1 and claim 6.

A method according to the above is previously known from the applicants own SE-B-464 761, wherein carbon dioxide is introduced below the liquid surface into the tank which holds the liquid. The introduced carbon dioxide thereby expands and provides thus cooling of the liquid. At the same time carbonating of the liquid is obtained. A method according to SE-B-464 761 has proved to function well with respect to providing an economic and efficient solution to the problem of carbonating and cooling liquids. In certain difficult situations, however, as e.g. in connection with large discharges of carbonated liquid from the tank, necessitating cooling of a relatively large amount of liquid fed into the tank, inadequate control of the ice formation within the tank will occur. This may lead to unwanted fluctuation in the output temperature and possibly also tendency of through freezing the liquid in the tank. By the fact that the device according to the known art lacks a buffer in the form of an ice bank which is located at a specific place in the tank, said fluctuations are accentuated.

It is a purpose of this invention to provide a solution to the above problems which solution, however, benefits from the advantages of the system according to SE-B-464 761, namely using one single system for cooling and carbonating.

The above purpose is achieved by the method and the device of the above mentioned kind being characterized by the features of the respective characterizing portions of claims 1 and 6.

By the features of claims 1 and 6 it is thus achieved that a controlled ice bank may be formed in the area where the liquid is thermally connected to the expansion room. By thus using a system where indeed carbon dioxide is used for cooling as well as carbonating, but where the expansion essentially takes place in a room which is separate from the liquid to be cooled, the formation of an uncontrolled slush of ice of microscopic or larger ice crystals is avoided, thus achieving essentially better liquid carbonating control. A complication with uncontrolled ice mass in the liquid is that essentially no carbonating may be obtained in the ice phase of the water. An excellent energy exchange between gas and liquid is also obtained because the gas after expansion being introduced into the liquid. Gas having been expanded in the expansion room will thus possibly comprise an energy deficiency , i.e. be under-cooled when it contacts the liquid, which contributes to the cooling of the liquid. The system according to the invention is thus energy saving and presents therefore an environmentally friendly alternative, as well as in view of the fact that carbon dioxide is used and not commonly used freon as the cooling agent.

By the feature in claim 2 and 14, respectively, particularly effective carbonating is achieved as well as further possibilities of using the remaining energy deficiency of the introduced carbon dioxide.

The features according to claim 4 and 16, respectively, allow in a per see known way a possibility of controlling the carbonating independently of if cooling has been initiated.

According to the feature in claim 5 and 17, respectively it is achieved that cooling may be initiated without all carbon dioxide used for that purpose being introduced into the liquid, whereby an unwanted excess of carbon dioxide in the liquid may be avoided.

The feature according to claim 7 brings about manufacturing of the device being possible in a very simple and economic way.

The feature according to claim 8 allows the use of a "clean" tank, where the ice bank is formed against the outer wall of the tank.

The feature according to claim 11 brings about cost effective use of an easily manufactured element forming the expansion room.

The feature according to claim 12 comprises a preferred construction of the device according to the invention allowing a particularly simplified and thus economic manufacture of the device.

By the feature according to claim 13 it is achieved that the formed ice bank may be held undisturbed from influence from currents in the tank induced by introduced carbon dioxide.

Further advantages and features of the invention will become clear from the following detailed description of embodiments with reference to the accompanying drawings, wherein:

FIG. 1 diagrammatically shows a first embodiment of the invention, and

Figure 2:
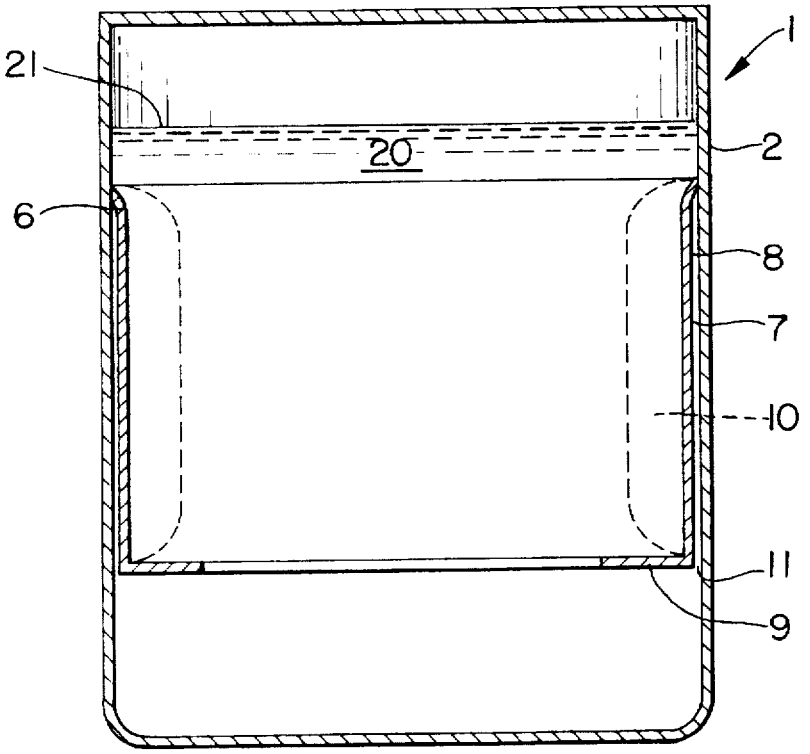

FIG. 2 diagrammatically shows a second embodiment of the invention.

Figure 3:
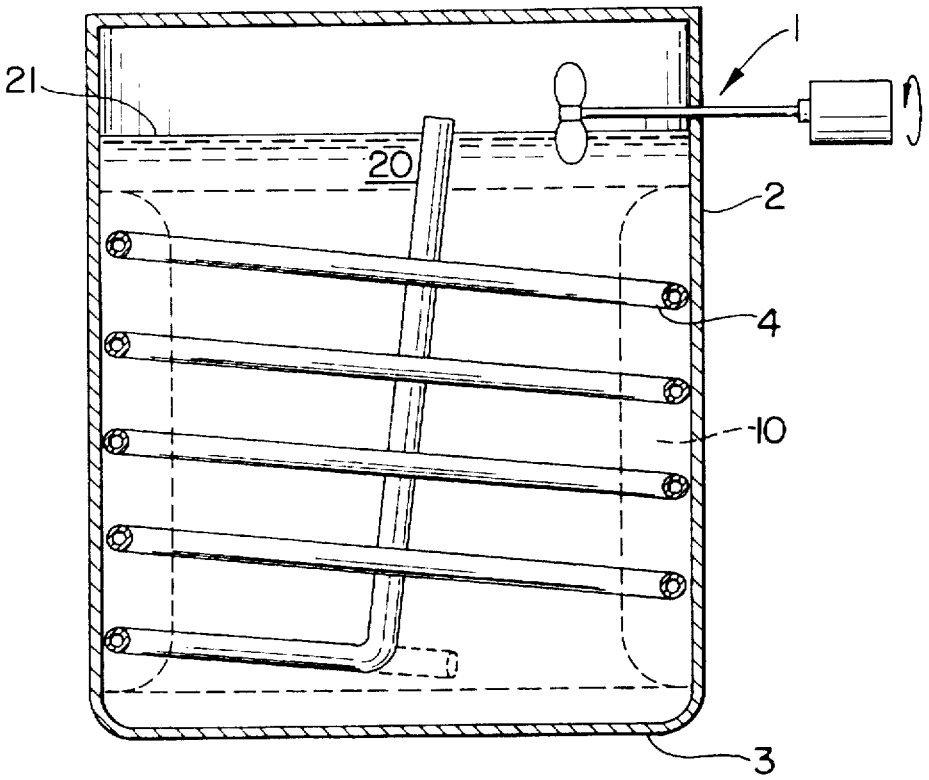

FIG. 3 diagrammatically shows a third embodiment of the invention.

Figure 4:
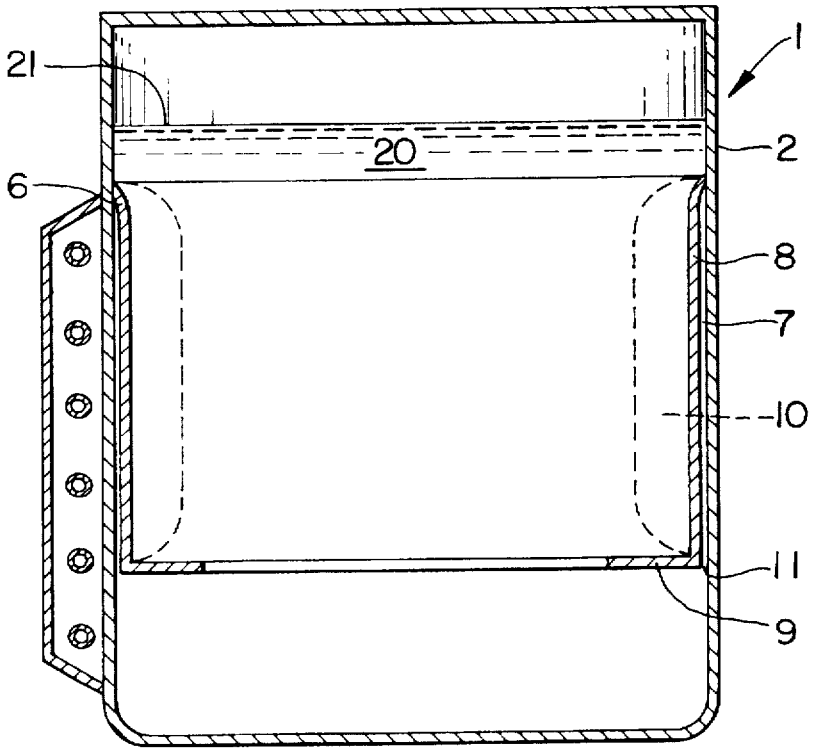

FIG. 4 diagrammatically shows a fourth embodiment of the invention.

FIG. 1 shows a device for cooling and carbonating, comprising a pressure tank 1 for the liquid 20 to be carbonated and cooled. The tank according to the embodiment comprises an essentially circular cylindric tank wall 2, an essentially plane bottom 3 and a cover, not indicated. Within the tank 1 a helical cooling coil 4 is arranged, generally adjacent to said tank wall 2. The cooling coil 4 forms the expansion room for supplied carbon dioxide, said coil 4 in fact being connected to a not shown carbon dioxide source via an, also not shown, inlet to the coil as well as possibly a compressor and a cooler. Preferably carbon dioxide being obtained at the gas space of the tank is recirculated to the compressor.

The cooling coil 4 is manufactured from a material which is approved in connection with foodstuffs and is terminated in its lower part by an opening 5 forming outlet from the coil and thus inlet to the liquid space of the tank.

In operation of the device, a so called ice bank (indicated with interrupted lines and designated with 10) in annular form will be formed around the tank wall 2. This ice bank is comprising a cooling buffer with respect to large discharges of carbonated liquid from the tank 1. After expansion in the cooling coil 4 the carbon dioxide enters into the liquid space of the tank 1 through opening 5. This way liquid present in tank 1 will be carbonated.

FIG. 2 shows a second embodiment of the device according to the invention, the tank 1 inwardly being provided with an upwardly closed expansion room 7, which is formed by a cooling wall 8 with a sealing portion 6, providing a seal against the tank wall 2, at its upper part. The cooling wall 8 thus forms an expansion gap 7 together with the tank wall 2, said expansion gap 7 being open downwards at 11 allowing outlet for the expanded carbon dioxide. It is preferred, which is shown in FIG. 2, that the cooling wall 8 is provided with an inward guiding means 9 in the form of an inward flange or the like at its lower portion in order to direct carbon dioxide emanating from the expansion gap 7 towards the centre parts of the tank 1. This way disturbing action from flowing liquid and gas on the ice bank (indicated by interrupted lines with 10) at the inward side of the cooling wall 8 is reduced. By said guiding means 9, the current induced by upwardly moving carbon dioxide is centered in the tank.

The shown embodiments are only to be regarded as examples of the invention which is only limited by the features defined in the claims. Many modifications are thus possible within the scope of said claims. It is e.g. fully possible to arrange the expansion room outside the tank wall 2, but maintaining a thermal contact between the cooling room and the liquid space, of the tank 1. The expansion room may in case of being pipe-shaped of course be shaped in an other way besides a helical shape. As an example coils with essentially vertical alternating with curved, essentially meandered configuration are possible. It is also possible, and within the scope of the invention, to supply just a portion of the carbon dioxide which is used for cooling for carbonating, because the cooling of the liquid generally demands a larger amount of carbon dioxide than does the carbonating of said liquid. For this purpose there may be control means arranged for branching off a part of e.g. circulating carbon dioxide for carbonating.

In the case where carbon dioxide for carbonating is introduced into the tank above the level 21 of the liquid, the gas may be force mixed into the liquid by means of a separate gas pump or the like. It is also possible to arrange one or more nozzles above or below the liquid surface, from which the carbon dioxide is blown into the liquid, possibly under formation of a rotational or other kind of current in the liquid.

In a preferred alternative embodiment of the invention, the expansion room for the gas (e.g. a pipe coil in accordance with FIG. 1) is arranged in a second liquid room outside the tank, whereby a so called external ice bank is formed in this second liquid room when the device is in operation. In this case the ice bank is thus formed in a liquid, which may be held at a lower pressure (possibly the atmospheric pressure) than the pressure within tank 1, which brings about faster build up of the ice bank, because, as is commonly known, the overpressure in a tank lowers the freezing-point of a contained liquid. A further advantage is reduced energy consumption. Said second liquid room may be formed by an extra wall outside the tank 1 in an annual shape, said room preferably not being totally filled with the liquid to allow expansion when the liquid is transferred to a solid phase. The extra wall may also be formed from a flexibel material to allow expansion of the liquid.

It is of course also within the scope of the invention that an external as well as an internal (within tank 1) ice bank is formed when in operation.

The device according to FIG. 2 is a very advantageous and inexpensive solution to the presented problem and the cooling wall 8 may of course also have another shape than what is shown in this Fig. For this purpose it may be suitable to form the cooling wall 8 in such a way that a helically shaped expansion room is formed between the cooling wall and the tank wall. Also with a cooling wall according to FIG. 2, a modification is possible, where the gas after expansion is introduced to the tank above the liquid level, whereby in that case the device may be completed according to what has been said above. In that case there is no need of a total sealing of the space 7 by means of a sealing element 6.

I claim:

1. A method for treating a liquid in a tank, comprising the step of:

expanding carbon dioxide within a space which is separate from said liquid but which creates a thermal coupling with said liquid, said liquid being cooled by said thermal coupling.

2. A method according to claim 1, further comprising the step of introducing said expanded carbon dioxide into said liquid within said tank to carbonate said cooled liquid.

3. A method according to claim 1, further comprising the steps of:

partially carbonating said liquid in said tank prior to said expanding step; and, directing said expanded carbon dioxide into said tank at a level above said liquid.

4. A method according to claim 3, comprising the step of force mixing said carbon dioxide into said liquid.

5. A method according to claim 1, comprising the step of directing only a part of said expanded carbon dioxide used for cooling into said liquid for carbonating said liquid.

6. A device for cooling and carbonating a liquid with carbon dioxide, comprising:

a tank for containing a liquid to be cooled and carbonated, said tank having an inlet for carbon dioxide; and, a space for expanding carbon dioxide, separate from said liquid but thermally coupled to said liquid for cooling said liquid, said expanded carbon dioxide entering said tank through said inlet.

7. A device according to claim 6, wherein said space is located within said tank.

8. A device according to claim 6, wherein said space is located outside said tank.

9. A device according to claim 8, wherein said space is located in an extra liquid space outside said tank and forms an external ice bank when said device is in operation.

10. A device according to claim 6, wherein said space comprises a pipe-shaped element.

11. A device according to claim 10, wherein said tank comprises an outer wall, said pipe-shaped element conforming and adhering to at least a part of said outer wall (2) of the tank.

12. A device according to claim 10, wherein said pipe-shaped element comprises at least one, at least substantially helical winding.

13. A device according to claim 6, wherein said space comprises an upwardly closed ring shaped configuration , having an inner wall which limits said space for said liquid.

14. A device according to claim 13, further comprising an inward directed guiding means for downwardly terminating said inner wall and through which said expanded carbon dioxide can be introduced into said liquid.

15. A device according to claim 6, wherein said liquid in said tank has an upper level and inlet for said expanded carbon dioxide is located below said upper level.

16. A device according to claim 6, wherein said liquid in said tank has an upper level and said inlet for said expanded carbon dioxide is located above said upper level.

17. A device according to claim 16, further comprising means for force mixing said carbon dioxide into said liquid.

18. A device according to claim 6, further comprising means for enabling only part of said expanded carbon dioxide to be directed into said liquid for carbonating said liquid.

* * * * *